US010343424B2

(12) United States Patent
Aoyagi et al.

(10) Patent No.: US 10,343,424 B2
(45) Date of Patent: Jul. 9, 2019

(54) TABLET PRINTING APPARATUS AND TABLET PRINTING METHOD

(71) Applicant: SHIBAURA MECHATRONICS CORPORATION, Yokohama-shi (JP)

(72) Inventors: Hitoshi Aoyagi, Yokohama (JP); Junsuke Komito, Yokohama (JP)

(73) Assignee: SHIBAURA MECHATRONICS CORPORATION, Yokohama-shi (JP)

( * ) Notice: Subject to any disclaimer, the term of this patent is extended or adjusted under 35 U.S.C. 154(b) by 0 days.

(21) Appl. No.: 15/846,843

(22) Filed: Dec. 19, 2017

(65) Prior Publication Data

US 2018/0104966 A1 Apr. 19, 2018

Related U.S. Application Data

(63) Continuation of application No. PCT/JP2016/068577, filed on Jun. 22, 2016.

(30) Foreign Application Priority Data

Jun. 29, 2015 (JP) ..... 2015-130488

(51) Int. Cl.
*B41J 11/00* (2006.01)
*A61J 3/06* (2006.01)
*B41J 2/01* (2006.01)

(52) U.S. Cl.
CPC ..... *B41J 11/0095* (2013.01); *A61J 3/06* (2013.01); *B41J 2/01* (2013.01)

(58) Field of Classification Search
CPC . B41J 2/01; B41J 11/0095; B41J 15/00; A61J 3/06; G01N 21/00
See application file for complete search history.

(56) References Cited

U.S. PATENT DOCUMENTS 5,423,252 A 6/1995 Yamamoto et al.
2012/0132722 A1 5/2012 Ackley, Jr. et al.
(Continued)

FOREIGN PATENT DOCUMENTS

EP 2 875 802 A1 5/2015
JP 6-143539 6/1994
(Continued)

OTHER PUBLICATIONS

International Search Report dated Sep. 20, 2016 in PCT/JP2016/068577, filed on Jun. 22, 2016.

*Primary Examiner* — Thinh H Nguyen
(74) *Attorney, Agent, or Firm* — Oblon, McClelland, Maier & Neustadt, L.L.P.

(57) ABSTRACT

According to one embodiment, a tablet printing apparatus includes: a first conveyor conveying a tablet while holding a other surface of the tablet; a second conveyor conveying the tablet transferred from the first conveyor while holding a one surface of the tablet; a first print head performing printing on the one surface of the tablet; a second print head performing printing on the other surface of the tablet; a first detection mechanism detecting the one surface of the tablet; a second detection mechanism detecting the other surface of the tablet; and a controller sending a printing instruction to the first and the second print heads based on information related to the state of a split line included in detection information on the one surface of the tablet or detection information on the other surface of the tablet.

10 Claims, 7 Drawing Sheets

(56) References Cited

U.S. PATENT DOCUMENTS

| | | | | |
|---|---|---|---|---|
| 2015/0174916 | A1 | 6/2015 | Hara et al. | |
| 2015/0191028 | A1 | 7/2015 | Hara et al. | |
| 2016/0180515 | A1 | 6/2016 | Seo et al. | |
| 2018/0170068 | A1* | 6/2018 | Hirano | A61J 3/06 |

FOREIGN PATENT DOCUMENTS

| | | | |
|---|---|---|---|
| JP | 2009-121919 | | 6/2009 |
| JP | 2013-013711 | A | 1/2013 |
| WO | WO 2014/013974 | | 1/2014 |
| WO | WO 2015/008742 | A1 | 1/2015 |

* cited by examiner

TABLET PRINTING APPARATUS AND TABLET PRINTING METHOD

CROSS-REFERENCE TO RELATED APPLICATION

This application is based upon and claims the benefit of priority from International Application No. PCT/JP2016/068577, filed on Jun. 22, 2016 and Japanese Patent Application No. 2015-130488, filed on Jun. 29, 2015; the entire contents of all of which are incorporated herein by reference.

FIELD

Embodiments described herein relate generally to a tablet printing apparatus and a tablet printing method.

BACKGROUND

There are various types of solid preparation printing apparatuses that can be used as an apparatus for printing letters or characters, marks, and the like on the surface of a solid preparation such as a tablet. In the printing apparatus, a transfer printing is performed on a solid preparation using a roller provided with a transferred pattern on its surface. When the printing is completed, whether the printing is acceptable or not is determined with an imaging device, a determination device, or the like.

Incidentally, some solid preparation (hereinafter referred to as "tablet") to be printed have a split line. When printing is performed on a tablet having a split line, it is required to avoid such a printing defect that the print overlaps the split line. In order to fulfill this requirement with a conventional printing apparatus, all tablets being conveyed have to be arranged such that their split lines are oriented to a certain direction (for example, the conveyance direction) with respect to the conveyance direction, and the surface having the split line have to face up (or down). If the direction of the split line deviates from a certain direction, a printing defect as described above occurs. The number of defects reaches several hundred thousand per hour.

DETAILED DESCRIPTION

Figure 1:
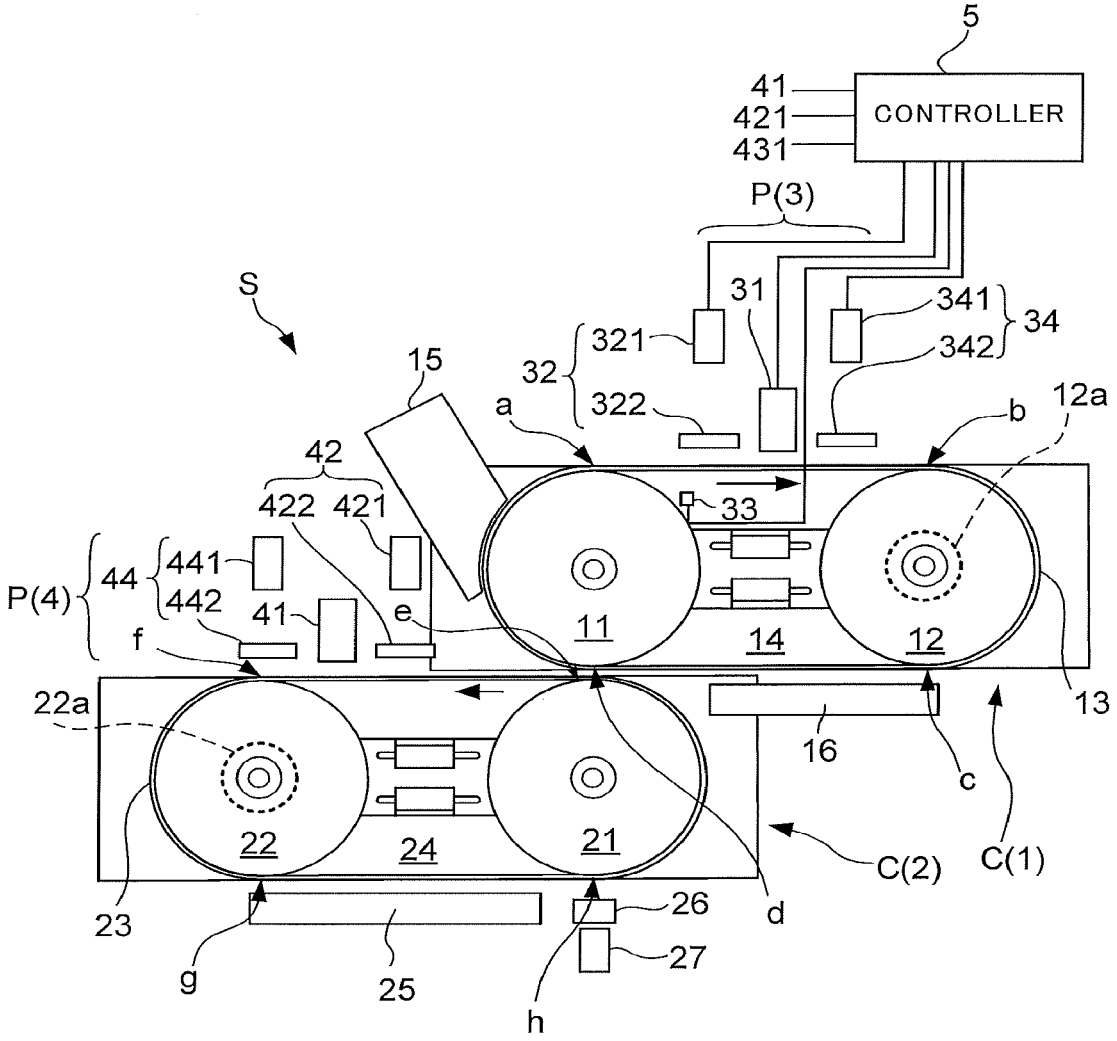
FIG. 1 is a front view illustrating the overall configuration of a tablet printing apparatus according to an embodiment.

According to one embodiment, a tablet printing apparatus is configured to perform printing on both surfaces of a tablet that has a split line on one surface of the both surfaces or the other surface. The tablet printing apparatus includes: a first conveyor configured to convey the tablet while holding the other surface of the tablet; a second conveyor configured to convey the tablet transferred from the first conveyor while holding a one surface of the tablet; a first print head configured to perform printing on the one surface of the tablet being conveyed by the first conveyor; a second print head configured to perform printing on the other surface of the tablet being conveyed by the second conveyor; a first detection mechanism configured to detect the one surface of the tablet being conveyed by the first conveyor; a second detection mechanism configured to detect the other surface of the tablet being conveyed by the first conveyor; and a controller configured to send a printing instruction to the first print head and the second print head based on information related to the state of the split line included in detection information on the one surface of the tablet acquired by the first detection mechanism or detection information on the other surface of the tablet acquired by the second detection mechanism.

According to another embodiment, a tablet printing method for performing printing on both surfaces of a tablet that has a split line on one surface of the both surfaces or the other surface, includes: conveying the tablet by a first conveyor holding the other surface of the tablet; detecting the one surface of the tablet being conveyed by the first conveyor by a first detection mechanism; detecting the other surface of the tablet being conveyed by the first conveyor by a second detection mechanism; performing printing on the one surface of the tablet being conveyed by the first conveyor by a first print head; conveying the tablet transferred from the first conveyor by a second conveyor holding the one surface of the tablet; and performing printing on the other surface of the tablet being conveyed by the second conveyor by a second print head. Upon performing the printing, a printing instruction is sent from a controller to the first print head and the second print head based on information related to the state of the split line included in detection information on the one surface of the tablet acquired by the first detection mechanism or detection information on the other surface of the tablet acquired by the second detection mechanism.

First Embodiment

Overall Configuration and Front Surface Printing

Referring now to the drawings, embodiments of the present invention will be described.

Figure 2:
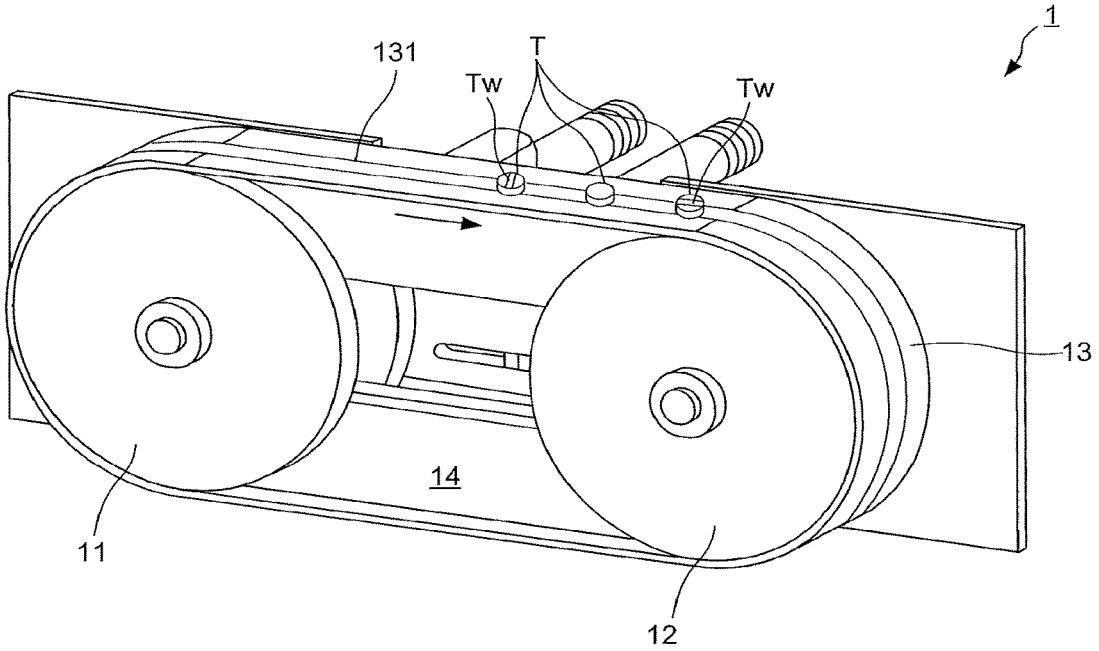
FIG. 2 is a perspective view illustrating the overall configuration of a conveyor of the embodiment.

FIG. 1 is a front view illustrating the overall configuration of a tablet printing apparatus S according to an embodiment. The tablet printing apparatus S includes a conveyor C configured to convey tablets T to be printed (see FIG. 2) and a printing mechanism P configured to perform printing on the tablets T conveyed by the conveyor C. FIG. 2 is a perspective view illustrating the overall configuration of the conveyor C of the embodiment.

It is assumed herein that the tablet T is circular in a plan view and a split line Tw (see FIG. 2) is formed on one of the surfaces.

The tablet printing apparatus S has two conveyors C, i.e., a first conveyor 1 and a second conveyor 2, to apply printing on both surfaces of the tablet T. The first conveyor 1 and the second conveyor 2 are arranged vertically.

The first conveyor 1 is provided with one printing mechanism P, i.e., a first printing mechanism 3. The second conveyor 2 is also provided with one printing mechanism P, i.e., a second printing mechanism 4. The first printing mechanism 3 is arranged above the first conveyor 1 and the second printing mechanism 4 is arranged above the second conveyor 2, thus constituting the tablet printing apparatus S.

The first conveyor 1 and the second conveyor 2 have basically the same configuration. The same applies to the first printing mechanism 3 and the second printing mechanism 4. Therefore, in the following, the conveyor C and the printing mechanism P are described by taking the first conveyor 1 and the first printing mechanism 3 as an example.

The first conveyor 1 includes a first pulley 11, a second pulley 12, an endless first conveyor belt 13 wrapped around the first and second pulleys 11 and 12, and a suction chamber 14 arranged inside the first conveyor belt 13.

The first pulley 11 is connected to a driving source and serves as a driving pulley that rotates clockwise. The second pulley 12 is a driven pulley that rotates as the first pulley 11 rotates through the first conveyor belt 13. Accordingly, the conveyor belt 13 stretched over the first pulley 11 and the second pulley 12 moves in the direction of an arrow indicated by a solid line in the upper horizontal area, i.e., it moves to the right from the first pulley 11 to the second pulley 12. The second pulley 12 is provided with a first encoder 12*a* on its support shaft. The encoder 12*a* measures the displacement amount of the tablet T in the first conveyor 1. A controller 5 (described later) can obtain the position of the tablet T in the first conveyor 1 based on an output signal from the encoder 12*a*.

In the following, the surface to be printed of the tablet T being conveyed by the first conveyor 1 is referred to as "front surface (one surface)", and that of the tablet T being conveyed by the second conveyor 2 is referred to as "back surface (other surface)".

As illustrated in FIG. 2, a slit 131 is formed on the surface of the first conveyor belt 13 for sucking the tablet T to be printed. The left and right of the slit 131 are partially connected to form a ladder shape. The slit 131 is formed over the entire circumference of the first conveyor belt 13. FIG. 2 illustrates the tablet T being conveyed and sucked by the slit 131. The tablet T is supplied from a tablet supply device 15 located on the upstream side of the first pulley 11 of the first conveyor 1 illustrated in FIG. 1 to the first conveyor 1.

The suction chamber 14 is arranged inside over the entire circumference of the first conveyor belt 13. The suction chamber 14 is configured to be capable of applying a suction force to the tablet T on the first conveyor belt 13 through the slit 131 formed in the first conveyor belt 13.

The first printing mechanism 3 is arranged in a position facing the surface of the first conveyor belt 13 that moves from the first pulley 11 toward the second pulley 12. In other words, the first printing mechanism 3 is located so as to face an area where the first conveyor belt 13 travels from the first pulley 11 to the second pulley 12 (area between reference letters a and b in FIG. 1, facing the upper horizontal portion of the conveyor belt 13).

The first printing mechanism 3 includes an ink jet first print head 31 that performs printing on the tablet T, a first surface detection mechanism 32, a back surface detection mechanism 33, a first printing state check device 34.

The first surface detection mechanism 32 (first detection mechanism) detects the state of the surface of the tablet T placed on the first conveyor belt 13 and conveyed such as, for example, the position of the tablet T, whether there is the split line Tw on the surface of the tablet T, if there is the split line Tw, the state of the split line Tw (the rotation direction and the angle with respect to the reference position of the split line Tw), the presence or absence of a shape defect (a crack or a chipping), and the like. The first surface detection mechanism 32 is located on the upstream side of the first print head 31 in the traveling direction of the first conveyor belt 13 and on the first print head 31 side of the first conveyor belt 13. The first surface detection mechanism 32 includes a first imaging device 321 configured to photograph the tablet T and a first illumination 322 configured to illuminate the tablet T to be photographed. The first imaging device 321 is connected to the controller 5, and detection information on the surface of the tablet T detected is sent to the controller 5.

On the other hand, the back surface detection mechanism 33 (second detection mechanism) detects the state of the back surface of the tablet T placed on the first conveyor belt 13 and conveyed such as, for example, the position of the tablet T, whether there is the split line Tw on the back surface, if there is the split line Tw, the state of the split line Tw (the rotation direction and the angle with respect to the reference position of the split line Tw), the presence or absence of a shape defect (a crack or a chipping), and the like. The back surface detection mechanism 33 is arranged inside the suction chamber 14. The back surface detection mechanism 33 is located on the upstream side of the first print head 31 in the traveling direction of the first conveyor belt 13 in a position shifted from the first surface detection mechanism 32 in the traveling direction of the conveyor belt 13. Detection information on the back surface of the tablet T detected by the back surface detection mechanism 33 is sent to the controller 5.

The detailed configuration of the back surface detection mechanism 33 will be described later with reference to FIGS. 3 to 6.

The first printing state check device 34 is provided on the downstream side of the first print head 31 in the traveling direction of the first conveyor belt 13 to check the state of printing on the surface of the tablet T applied by the first print head 31. The first printing state check device 34 includes an imaging device 341 configured to photograph the printing state of the tablet T and an illumination 342 configured to illuminate the tablet T to be photographed. The imaging device 341 captures an image of the tablets T, and sends the image to the controller 5. The controller 5 determines whether printing is acceptable or not based on the image. Incidentally, examples of printing defects include ink bleeding and the deviation of the printing position by more than an allowable amount with respect to a predetermined position.

As described above, the controller 5 receives detection information from the first surface detection mechanism 32 and the back surface detection mechanism 33, and captured images from the first printing state check device 34. The controller 5 obtains the states of the front and back surfaces of the tablet T from the detection information received from the first surface detection mechanism 32 and the back surface detection mechanism 33, and supplies a drive signal to the first print head 31 to perform appropriate printing according to the detection information. Details will be described in the section of the printing process and the process of grasping a split line of the tablet T (described later).

In an area where the first conveyor belt 13 travels from the second pulley 12 to the first pulley 11, a first drying device 16 is provided for drying ink by blowing hot air onto the tablet T after printing. The first drying device 16 is located between a position c where the conveyor belt 13 is reversed with the rotation of the second pulley 12 and separates from the second pulley 12 and a position d where the conveyor belt 13 head to the first pulley 11 and where it does not interfere with the movement of a first pulley 21 in the second conveyor 2.

The above is a configuration for appropriately completing printing on the surface of the tablet T placed on the first conveyor 1.

Back Surface Printing

Described below is a configuration for printing on the back surface of the tablet T.

The second conveyor 2 located below the first conveyor 1 conveys the tablet T such that the second printing mechanism 4 located above it can perform printing on the back surface of the tablet T.

The basic configuration of the second conveyor 2 is basically the same as that of the first conveyor 1. That is, the second conveyor 2 includes the first pulley 21 as a driving source, a second pulley 22 as a driven pulley, an endless second conveyor belt 23 wrapped around the first and second pulleys 21 and 22, and a suction chamber 24 arranged inside over the entire circumference of the second conveyor belt 23.

Similarly to the first conveyor belt 13, a slit (not illustrated) is formed on the surface of the second conveyor belt 23 for placing and holding the tablet T to be printed.

The first pulley 21 and the second pulley 22 of the second conveyor 2 rotates counterclockwise. Accordingly, the second conveyor belt 23 wrapped around these pulleys moves to the left as indicated by an arrow in the upper horizontal area of the second conveyor 2.

The second conveyor belt 23 faces the first conveyor belt 13 on the downstream side of the first drying device 16 in the first conveyor 1. Therefore, in an area where the first conveyor belt 13 of the first conveyor 1 meets the second conveyor belt 23 of the second conveyor 2, both the belts move in the same direction, i.e., leftward in FIG. 1.

The first conveyor belt 13 and the second conveyor belt 23 have the same conveying speed. Thus, there is no relative speed difference between them. The conveying speeds of the first conveyor belt 13 and the second conveyor belt 23 can be synchronized, and the tablet T can be transferred smoothly from the first conveyor 1 to the second conveyor 2.

The first pulley 11 of the first conveyor 1 and the first pulley 21 of the second conveyor 2 are positioned such that their axes are aligned in the vertical direction. The tablet T is transferred at a position where the first conveyor belt 13 is in contact with the first pulley 11 of the first conveyor 1 (the position indicated by reference numeral d in FIG. 1), and the second conveyor belt 23 is separated from the first pulley of the second conveyor 2 (the position indicated by reference numeral e in FIG. 1).

The second pulley 22 is provided with a second encoder 22*a* on its support shaft. The encoder 22*a* measures the displacement amount of the tablet T in the second conveyor 2. The controller 5 can obtain the position of the tablet T in the second conveyor 2 based on an output signal from the encoder 22*a*.

The tablet T transferred from the first conveyor 1 to the second conveyor 2 is placed on the conveyor belt 23 in a state where the back surface opposite to the surface printed by the first printing mechanism 3 faces the second printing mechanism 4 side when the second conveyor belt 23 is viewed from above.

The suction chamber 24 is configured to apply a suction force to the tablet T placed on the second conveyor belt 23 through the slit of the second conveyor belt 23.

The second conveyor 2 is configured as described above. The second printing mechanism 4 is arranged above the second conveyor 2 so as to face thereto. In other words, the second printing mechanism 4 is arranged so as to face an area where the conveyor belt 23 moves from the first pulley 21 to the second pulley 22 (area between reference letters e and f in FIG. 1, facing the upper horizontal portion of the conveyor belt 23).

The second printing mechanism 4 includes, similarly to the first printing mechanism 3, an ink jet second print head 41 configured to perform printing on the tablet T, a second surface detection mechanism 42, a second printing state check device 44.

The second surface detection mechanism 42 (third detection mechanism) is located on the upstream side of the second print head 41 in the traveling direction of the conveyor belt 23. The second surface detection mechanism 42 includes an imaging device 421 configured to photograph the tablet T and an illumination 422 configured to illuminate the tablet T to be photographed, and detects the position of the tablet T.

The second printing state check device 44 is located on the downstream side of the second print head 41 in the traveling direction of the conveyor belt 23. The second printing state check device 44 includes an imaging device 441 configured to photograph the printing state of the tablet T and an illumination 442 configured to illuminate the tablet T to be photographed. Similarly to the first printing mechanism 3, any of them is controlled by the controller 5.

The controller 5 receives detection information relating to the tablet T that has reached the second surface detection mechanism 42 obtained by the first surface detection mechanism 32 or the back surface detection mechanism 33 as well as detection information acquired by the second surface detection mechanism 42 and images captured by the second printing state check device 44. The controller 5 obtains information on the split line Tw of the tablet T based on the detection information received from the first surface detection mechanism 32 or the back surface detection mechanism 33. In addition, the controller 5 supplies a drive signal to the second print head 41 to perform appropriate printing according to the detection result based on the position information obtained from the second surface detection mechanism 42. Details will be described in the section of the printing process and the process of grasping the split line Tw of the tablet T (described later).

In an area where the second conveyor belt 23 travels from the second pulley 22 to the first pulley 21 (area between reference letters g and h in FIG. 1), a second drying device 25 is provided for drying ink on the tablet T after printing.

At a position on the downstream side of the second drying device 25, there are provided boxes for collecting the tablets T, each having printed on its front and back surfaces according to the suitability of printing. The controller 5 determines whether printing is acceptable or not for each tablet T based on the check result received from the first printing state check device 34 and the second printing state check device 44. When the printing state is appropriate, the tablet T is sent from the second conveyor belt 23 to a non-defective product collection box 26. On the other hand, when the printing state is inappropriate, the tablet T is sent from the conveyor belt 23 to a defective product collection box 27.

Configuration of the First Suction Chamber and the Back Surface Detection Mechanism With reference to FIGS. 3 to 6, a detailed description will be given of the configurations of the first suction chamber 14 and the back surface detection mechanism 33 in the configuration of the conveyor C.

Figure 3:
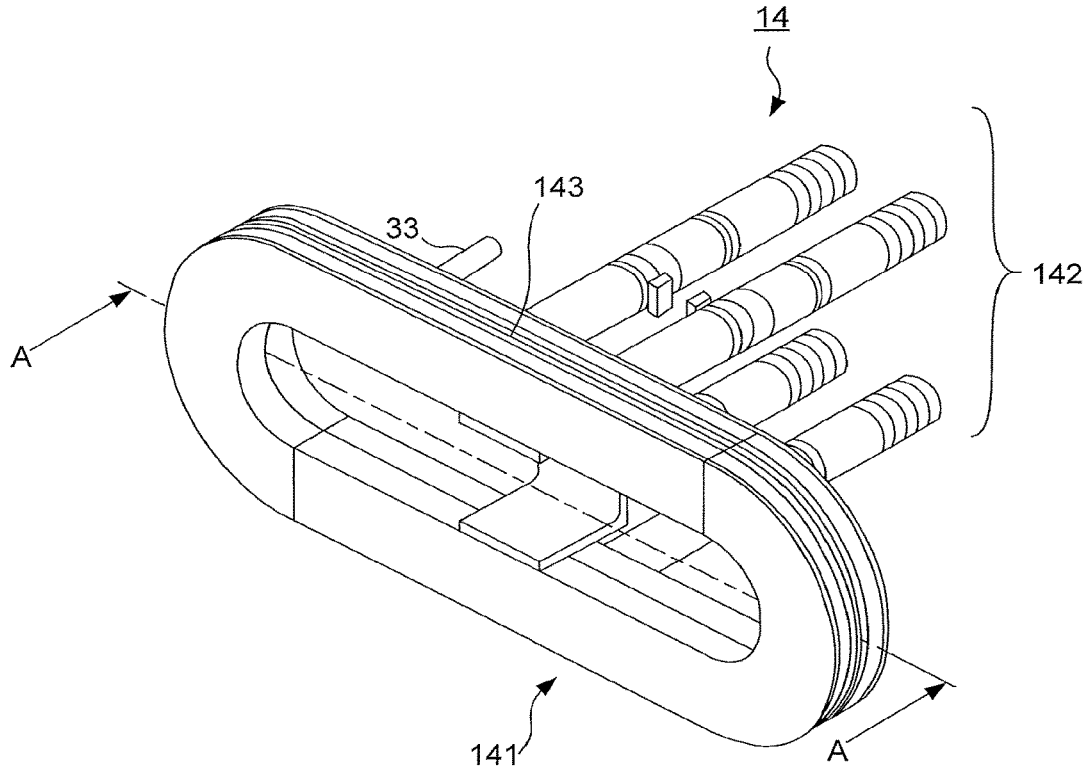
FIG. 3 is a perspective view illustrating the overall configuration of a suction chamber of the embodiment.

FIG. 3 is a perspective view illustrating the overall configuration of the first suction chamber 14, which is illustrated in substantially the same orientation as the perspective view of FIG. 2 illustrating the overall configuration of the first conveyor 1. Although not illustrated in FIG. 3, the first pulley 11 is provided on the far side and the second pulley 12 is provided on the front side so as to sandwich the first suction chamber 14 on the left front side.

The first suction chamber 14 includes a chamber body 141 configured to apply a suction force to the tablet T in combination with the first pulley 11, the second pulley 12, and the conveyor belt 13, and a suction path 142 which is connected to a pump (not illustrated) to perform suction.

Figure 4:
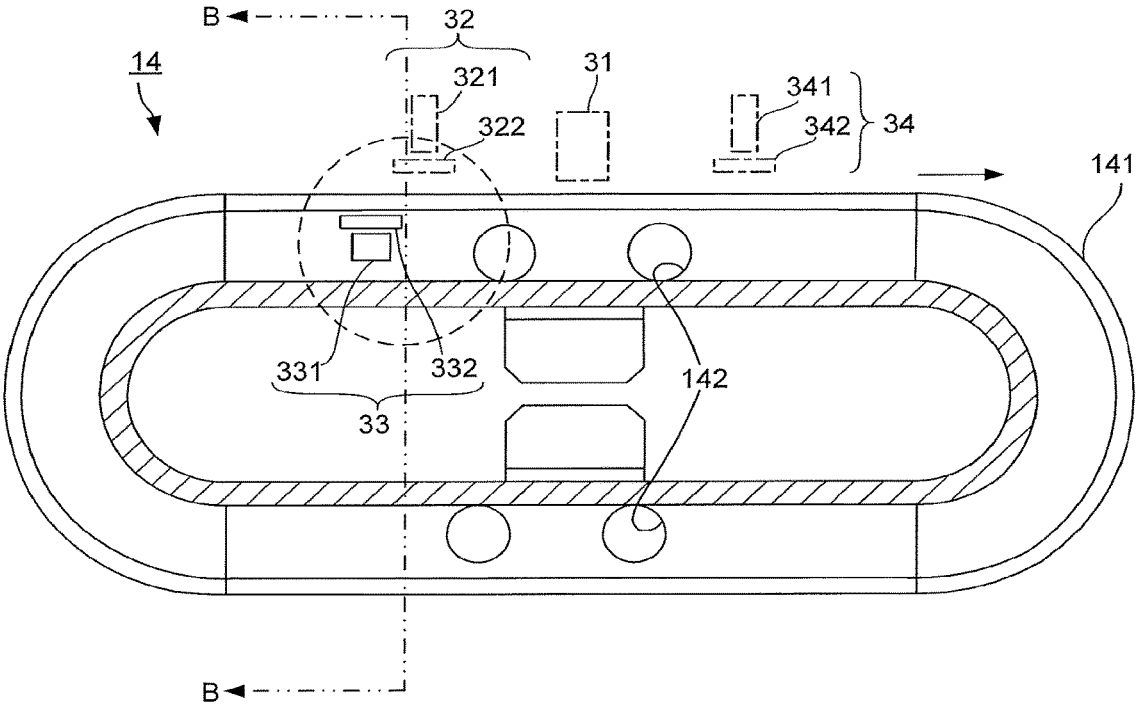
FIG. 4 is a cross-sectional view taken along line A-A in FIG. 3 which illustrates the front view of the suction chamber, illustrating a configuration of a back surface detection mechanism of a first embodiment.

FIG. 4 is a cross-sectional view taken along line A-A in FIG. 3 which illustrates the front view of the suction chamber, illustrating a configuration of the back surface detection mechanism 33. As illustrated in FIG. 4, the back surface detection mechanism 33 is provided inside the chamber body 141 of the first suction chamber 14.

The back surface detection mechanism 33 includes an imaging device 331 configured to photograph the back surface of the tablet T and an illumination 332 configured to illuminate the back surface of the tablet T to be photographed through the slit 131 of the first conveyor belt 13.

In FIG. 4, in order to illustrate the positional relationship of the back surface detection mechanism 33, each device constituting the first printing mechanism 3 is indicated by an imaginary line above the suction chamber 14. Although the conveyor belt 13 is not illustrated, its traveling direction is rightward as indicated by an arrow in FIG. 4. The back surface detection mechanism 33 is located in the most upstream position in the traveling direction of the conveyor belt 13 among the devices constituting the first printing mechanism 3. Accordingly, the tablet T (not illustrated) placed on the conveyor belt 13 by the action of the suction force from the slit 131 is conveyed in the traveling direction of the conveyor belt 13 as the conveyance direction. After passing above the back surface detection mechanism 33, the tablet T passes directly below the first surface detection mechanism 32, and reaches the first print head 31.

Figure 5:
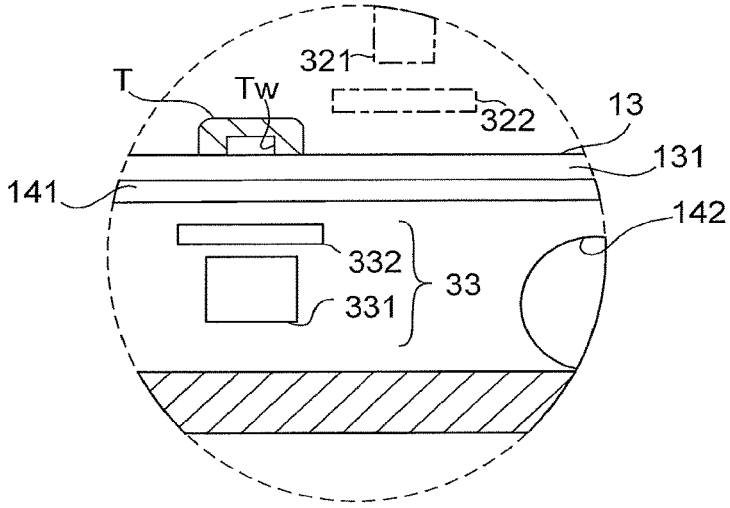
FIG. 5 is an enlarged view of a portion surrounded by a broken line in FIG. 4 and also illustrates a conveyor belt and a tablet for understanding.

FIG. 5 is an enlarged view of a portion surrounded by a broken line in the cross-sectional view of FIG. 4 and also illustrates the conveyor belt 13 and the tablet T for understanding.

In FIG. 5, the first conveyor belt 13 is illustrated on the chamber body 141 of the first suction chamber 14. Regarding the first conveyor belt 13, the slit 131 is illustrated. The tablet T placed on the first conveyor belt 13 by a suction force from the slit 131 is illustrated in a cut state. In the tablet T, the split line Tw is formed.

Figure 6:
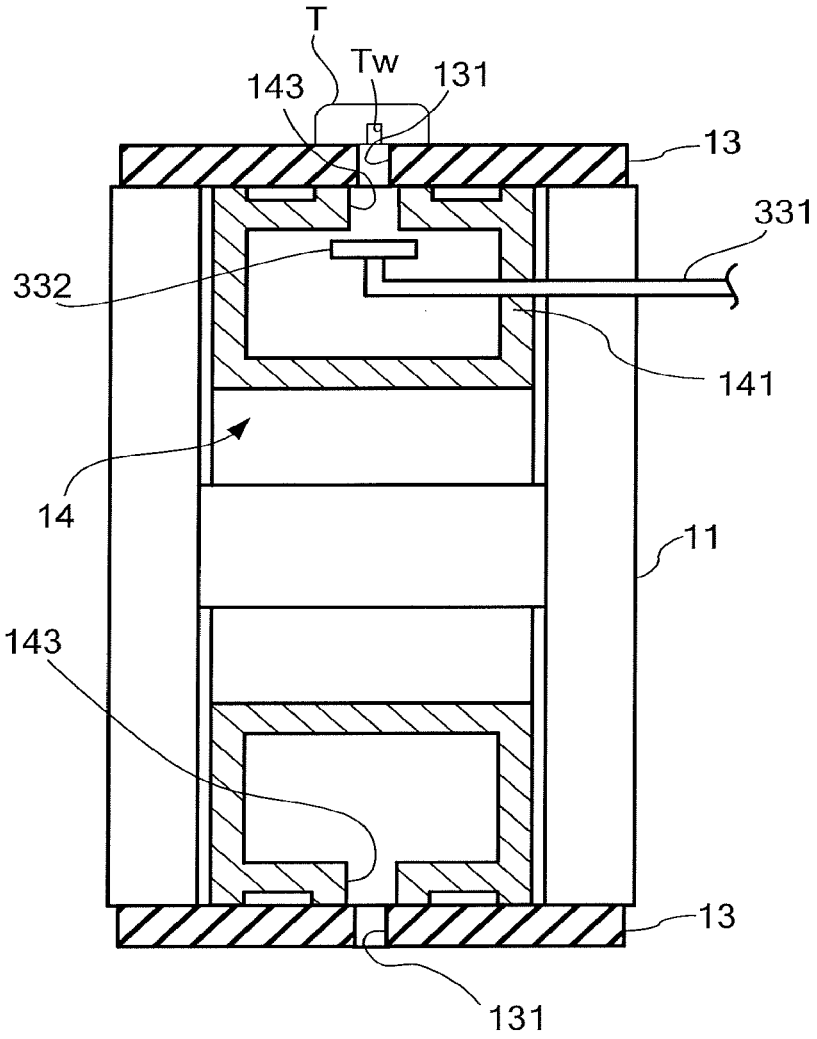
FIG. 6 is a cross-sectional view taken along line B-B in FIG. 4, illustrating a configuration of the back surface detection mechanism.

FIG. 6 is a cross-sectional view taken along line B-B in FIG. 4, illustrating a configuration of the back surface detection mechanism 33. In FIG. 6, the left side corresponds to the front side of the first conveyor 1 illustrated in FIG. 1. FIG. 6 illustrates the conveyor belt 13 and the tablet T to facilitate understanding, and the direction of the split line Tw of the tablet T is shifted by 90 degrees from that in FIG. 5.

In this cross-sectional view, the upper side of the rotation axis of the first pulley 11 indicates that the tablet T is placed on the first conveyor belt 13 from the tablet supply device 15 and reaches the first surface detection mechanism 32, for example, a part between the portion denoted by reference letter a in FIG. 1 and the first surface detection mechanism 32.

As illustrated in FIG. 3, the chamber body 141 is provided with a suction groove 143, which is a suction portion for sucking air, over the entire circumference thereof. The suction groove 143 is located immediately below the slit 131 of the first conveyor belt 13 which is wrapped around the first pulley 11 and the second pulley 12. Therefore, when the chamber body 141 sucks air through the suction path 142, air is sucked from the suction groove 143 and the slit 131 of the conveyor belt 13. Thus, the tablet T is sucked and held on the conveyor belt 13 as receiving the suction force from the slit 131.

The back surface detection mechanism 33 is provided such that the lens barrel of the imaging device 331 is inserted into the suction chamber 14. The imaging device 331 collects information on the state of the back surface of the tablet T through the suction groove 143 and the slit 131 of the conveyor belt 13 in such a manner as looking up from the bottom. Since the split line Tw is formed on the back surface of the tablet T illustrated in FIG. 5, information on the state of the split line Tw (specifically, the rotation direction and the angle with respect to the reference position of the split line Tw, hereinafter sometimes referred to as "split line information") is acquired by the back surface detection mechanism 33 and sent to the controller 5.

Printing Process

Next, with reference to FIG. 1, the printing process on the tablet T using the tablet printing apparatus S will be described step by step.

First, the tablets T stored in the tablet supply device 15 are supplied to the first pulley 11 of the first conveyor 1 that rotates to the right. The tablets T supplied from the tablet supply device 15 are sequentially placed on the conveyor belt 13 one by one.

The tablets T placed on the conveyor belt 13 are sucked and held on the conveyor belt 13 and do not fall due to a suction force applied from the suction chamber 14 through the slit 131.

The tablets T are conveyed while being sucked and held on the conveyor belt 13 by the suction chamber 14. A letter or a character, a figure, or the like set in advance is printed on the surface of the tablets T by the first printing mechanism 3 arranged above the first conveyor 1.

Specifically, first, the controller 5 acquires information on the front and back surfaces of the tablet T sucked and held on the first conveyor belt 13 through the slit 131 by the first surface detection mechanism 32 and the back surface detection mechanism 33. The controller 5 checks the position of the tablet T, the presence or absence of the split line Tw, and the like. Information such as the position of the tablet T photographed by the imaging device 321 or the imaging device 331, the presence or absence of the split line Tw, and the state of the split line Tw when it is present are sent to the controller 5. The controller 5 determines whether printing can be performed by the first print head 31, the selection of printing content, the orientation of printing, and the like based on this information.

In this embodiment, the split line Tw is formed on one of the surfaces of the tablet T. Therefore, the information on the state of the split line Tw is obtained by either the first surface detection mechanism 32 or the back surface detection mechanism 33. Thus, the controller 5 can determine whether the split line Tw is formed on the front or back surface of the tablet T depending on which detection mechanism acquires the information on the state of the split line Tw.

For example, as illustrated in FIG. 6, when the tablet T is conveyed with the surface having the split line Tw facing down, the back surface detection mechanism 33 can detect the state of the split line Tw, while the first surface detection mechanism 32 cannot. In this case, the controller 5 uses the position information of the tablet T and information on the state of the split line Tw (the rotation direction and the angle with respect to the reference position of the split line Tw) from among pieces of information detected by the back surface detection mechanism 33 to generate a print pattern by correcting a predetermined print pattern to be printed on the surface of the tablet T (a print pattern that does not overlap the split line Tw when printed normally) based on the position, angle, and rotation direction. Then, the controller 5 controls the first printing mechanism 3 based on this print pattern corrected, and, when the tablet T reaches the printing position of the first print head 31, printing is performed on the surface of the tablet T (in this case, the surface opposite to the surface on which the split line Tw is formed).

When the ink jet head is used as the print head, it is possible to correspond to the modifying of a pattern to be printed by simply changing an ejection pattern signal sent to the print head.

On the other hand, unlike the state illustrated in FIG. 6, when the tablet T is conveyed with the surface having the split line Tw facing up, the split line Tw is detected by the first surface detection mechanism 32. Therefore, the controller 5 corrects the print pattern based on the information on the state of the surface of the tablet T obtained from the first surface detection mechanism 32. The controller 5 controls the first printing mechanism 3 based on the print pattern corrected to perform printing on the surface of the tablet T on which the split line Tw is formed.

Generally, different patterns are printed on the front and back surfaces of the tablet T. Since it is possible to determine whether the split line Tw is formed on the front or back surface of the tablet T as described above, it is possible to determine which one of print patterns is used for the tablet T that has reached the printing position of the first print head 31.

Further, the controller 5 uses information on the presence or absence of a shape defect from among pieces of information detected by the first surface detection mechanism 32 and the back surface detection mechanism 33. Having determined that printing cannot be performed such as in the case where the tablet T is chipped, the controller 5 does not perform printing on the tablet T and lets the tablet T pass under the first printing mechanism 3.

When the first print head 31 finishes printing, the tablet T is conveyed and then moves to under the first printing state check device 34.

The first printing state check device 34 captures an image of the tablet T conveyed and sends the image to the controller 5. The controller 5 determines whether printing is appropriate or not based on the information sent from the first printing state check device 34.

Thereafter, the tablet T is reversed by the second pulley 12 while being placed on the first conveyor belt 13, and moves from the upper portion to the lower portion of the first conveyor 1.

As illustrated in FIG. 1, ink adhering to the surface of the tablet T reversed is dried by the first drying device 16 arranged in a position where the first conveyor belt 13 moves from the second pulley 12 to the first pulley 11 in the left direction in FIG. 1 (between c and d in FIG. 1).

In the second conveyor 2, printing is performed on the back surface of the tablet T.

The printing is performed as follows: First, information on the state of the split line Tw of the tablet T that has reached the printing position of the second printing mechanism 4 is obtained from the first surface detection mechanism 32 or the back surface detection mechanism 33.

More specifically, while the tablet T is being conveyed by the first conveyor 1, information on the split line Tw (the rotation direction and the angle with respect to the reference position of the split line Tw) and information on the orientation of the surface having the split line Tw (whether the surface faces up and the split line Tw faces the second print head, or faces down and the split line Tw is located at the opposite side) are obtained from among pieces of detection information already obtained by either the first surface detection mechanism 32 or the back surface detection mechanism 33. The controller 5 selects a print pattern for the back surface to be printed by the second printing mechanism 4 from information on the orientation of the surface on which the split line Tw is formed. By using the information on the split line Tw and the position information of the tablet T obtained from the photographic information acquired by the second surface detection mechanism 42, the controller 5 generates a print pattern to be printed by correcting the predetermined pattern to be printed on the back surface of the tablet T (a print pattern that does not overlap the split line Tw when printed normally) based on the position, angle, and rotation direction.

Then, the controller 5 controls the second printing mechanism 4 based on the print pattern corrected to perform printing on the back surface of the tablet T when the tablet T reaches the printing position of the second print head 41. When the tablet T is conveyed in the state as illustrated in FIG. 6 in the first conveyor 1, since the front surface and the back surface of the tablet T are switched in the second conveyor 2, a print pattern set in advance for the surface having the split line Tw is printed on the surface on which the split line Tw is formed.

After the printing is performed by the second print head 41, the printing state is checked based on information from the second printing state check device 44.

Ink on the tablet T after the printing is dried by the second drying device 25 in the lower horizontal area of the second conveyor belt 23. At this time, the back surface of the tablet T printed by the second printing mechanism 4 faces the second drying device 25, and the ink is dried while the conveyor belt 23 moves from the second pulley 22 to the first pulley 21.

The dried tablets T are collected and stored in the non-defective product collection box 26 or the defective product collection box 27. When the controller 5 determines that there is no shape defect in the tablet T and printing has been appropriately performed thereon based on the check results from the first surface detection mechanism 32, the back surface detection mechanism 33, the first printing state check device 34, and the second printing state check device 44, the tablet T is stored in the non-defective product collection box 26. On the other hand, when the controller 5 determines that there is a shape defect or a printing defect in the tablet T, the tablet T is stored in the defective product collection box 27.

Thus, the printing process for the tablet T is completed.

Process of Grasping a Split Line of a Tablet

Figure 7:
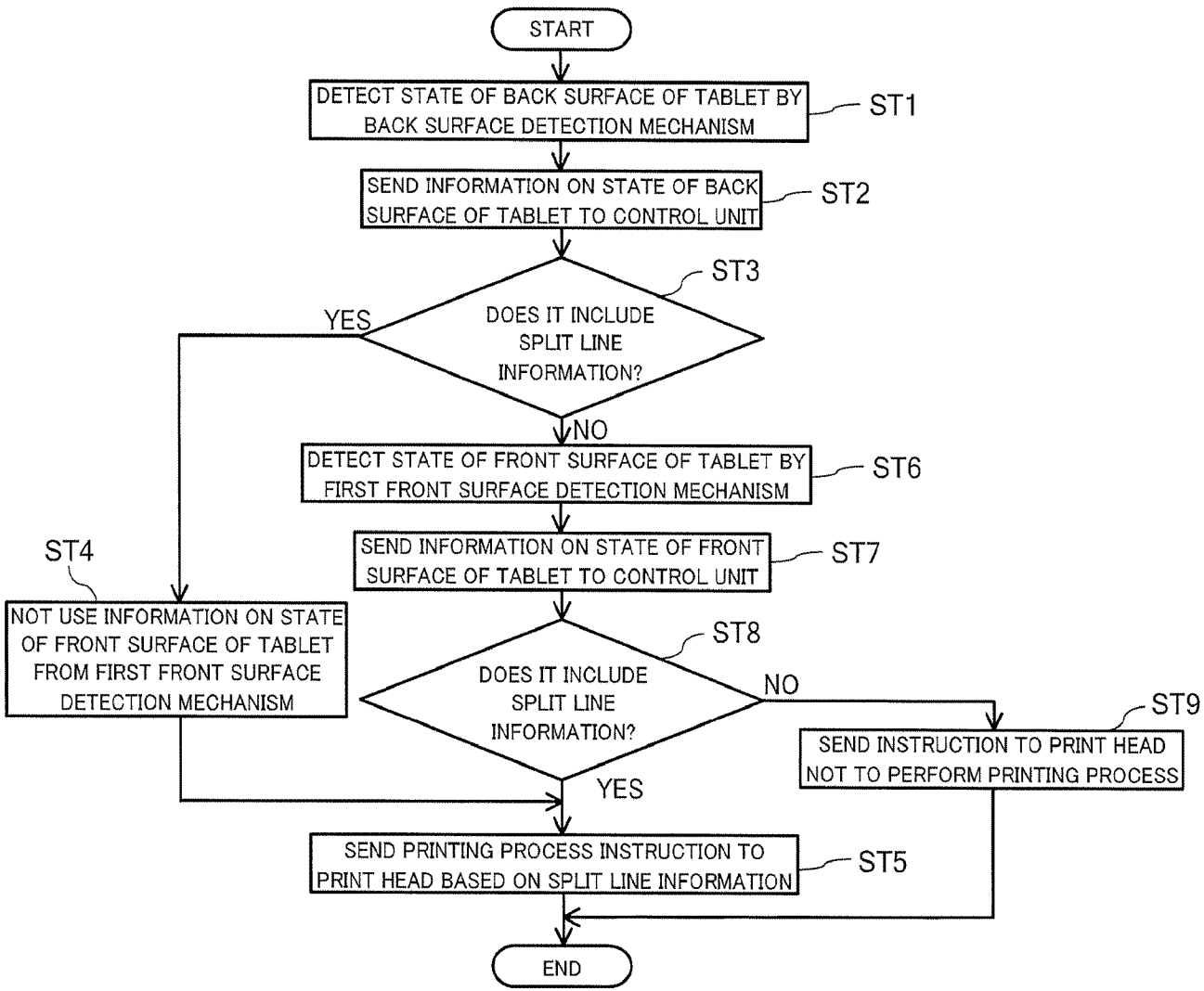
FIG. 7 is a flowchart illustrating the operation of grasping the state of a split line of a tablet using a first surface detection mechanism and the back surface detection mechanism of the first embodiment and reflecting the state to a printing process.

Next, with reference to the flowchart of FIG. 7, a description will be given of the process of grasping the state of the split line Tw of the tablet T using the first surface detection mechanism 32 and the back surface detection mechanism 33.

When the tablet T is supplied from the tablet supply device 15 onto the conveyor belt 13, it is placed on the first conveyor belt 13 and conveyed from reference numeral a to b in FIG. 1, thus, toward the first print head 31. During the conveyance, the back surface detection mechanism 33 detects the state of the back surface of the tablet T (ST1).

The back surface detection mechanism 33 sends information on the state of the back surface of the tablet T as a detection result to the controller 5 (ST2). The controller 5 analyzes the information received from the back surface detection mechanism 33, and checks whether it includes information on the split line Tw (ST3). When it includes the information on the split line Tw (YES in ST3), the information on the split line Tw is used in the printing process for the tablet T.

After passing through the position of the back surface detection mechanism 33, the tablet T passes immediately below the first surface detection mechanism 32. At this time, the first surface detection mechanism 32 acquires information on the state of the front surface of the tablet T, and sends it to the controller 5 (ST6, ST7).

When the controller 5 has received the information on the split line Tw from the back surface detection mechanism 33, the controller 5 does not use the information received from the first surface detection mechanism 32 (ST4) upon sending an instruction as to the printing process on the tablet T to the first print head 31 (ST5). In other words, the controller 5 uses only the detection information received from the back surface detection mechanism 33.

The controller 5 grasps the rotation direction and the angle with respect to the reference position of the tablet T based on the information on the split line Tw received from the back surface detection mechanism 33. The controller 5 sends a printing process instruction to the first print head 31 to use the information and perform the printing process (ST5). The first print head 31 performs the printing process according to the instruction received. Since printing is performed in consideration of the orientation of the split line Tw and the like, the printing process is performed on the tablet T appropriately.

On the other hand, when the detection result of the state of the back surface of the tablet T obtained by the back surface detection mechanism 33 does not include information on the split line Tw (NO in ST3), the controller 5 waits for information from the first surface detection mechanism 32. The first surface detection mechanism 32 detects the state of the front surface of the tablet T (ST6).

The first surface detection mechanism 32 sends information on the state of the front surface of the tablet T as a detection result to the controller 5 (ST7). The controller 5 analyzes the information received from the first surface detection mechanism 32, and checks whether it includes information on the split line Tw (ST8).

When the information sent from the first surface detection mechanism 32 includes information on the split line Tw (YES in ST8), the controller 5 grasps the rotation direction and the angle with respect to the reference position of the tablet T based on the information on the split line Tw. The controller 5 sends a printing process instruction to the first print head 31 to use the information and perform the printing process (ST5).

In this manner, the controller 5 sends a printing process instruction to the first print head 31 using the detection information including the information on the split line Tw among pieces of detection information received from either the first surface detection mechanism 32 or the back surface detection mechanism 33.

However, there may be a case where both the detection mechanism cannot detect information on the split line Tw depending on the orientation of the tablet T placed on the slit 131 or the like. In this case, the controller 5 cannot obtain information on the split line Tw from either the back surface detection mechanism 33 or the first surface detection mechanism 32. When this is the case (NO in ST8), the controller 5 cannot determine the orientation of printing with respect to the tablet T, and sends an instruction to the first print head 31 not to perform the printing process on the tablet T (ST9).

As described above, when one of the first surface detection mechanism 32 and the back surface detection mechanism 33 detects information on the split line Tw, the controller 5 does not use information on the state of the tablet T detected by the other detection mechanism. With this, the controller 5 can quickly grasp the state of the tablet T and send a printing process instruction to the first print head 31 based on the state of the tablet T.

Therefore, when the split line Tw is formed on one side of the tablet T, even if there are variations in the orientation of the split lines Tw of the tablets T being conveyed or the orientation of the surfaces with the split line Tw, printing can be performed on the surfaces of tablets T with the split line Tw and the opposite surfaces such that the print does not overlap the split line Tw or a position corresponding to the split line Tw. Thus, it is able to provide a tablet printing apparatus S and a tablet printing method capable of maintaining the printing quality.

In particular, both the first surface detection mechanism 32 and the back surface detection mechanism 33 are arranged in the rear of a position where the tablet T is placed on the first conveyor belt 13. Therefore, for example, the detection mechanisms can send the accurate position of the split line Tw to the controller 5 regardless of the displacement of the tablet T caused when the tablet T is supplied from the tablet supply device 15 onto the first conveyor belt 13. Thus, the printing process can be performed accurately on the tablet T.

Second Embodiment

Next, a second embodiment will be described. In the second embodiment, like reference numerals designate like constituent elements as those described in the first embodiment, and the same description will not be repeated.

In the first embodiment described above, as explained with reference to FIGS. 4 to 6, the back surface detection mechanism 33 includes the imaging device 331, and photographs the state of the back surface of the tablet T by using the imaging device 331. On the other hand, in the second embodiment, the back surface detection mechanism 33 has a configuration that does not use the imaging device 331.

Figure 8:
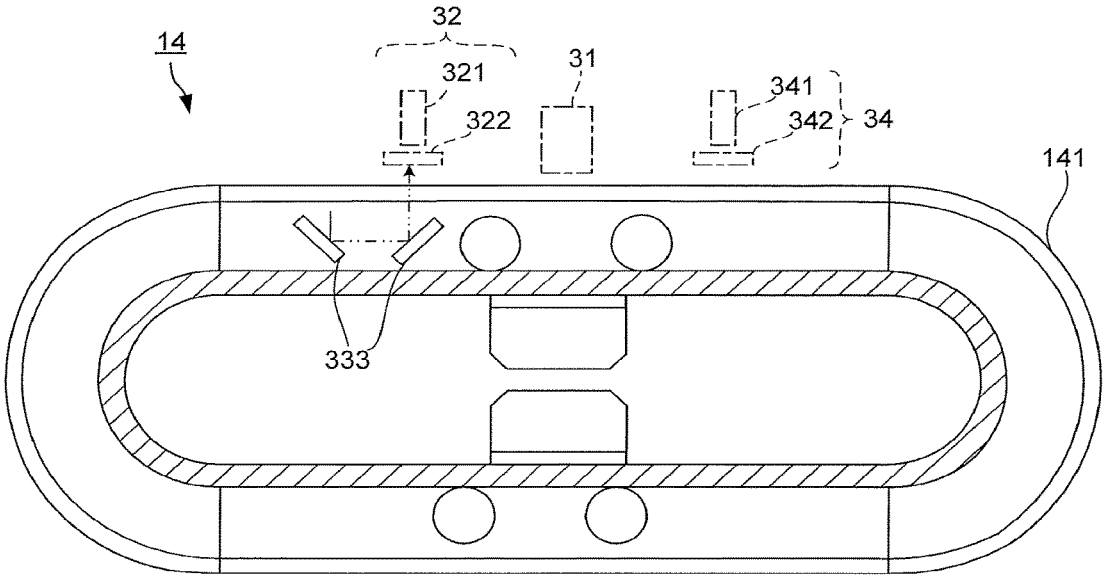
FIG. 8 is a cross-sectional view of a back surface detection mechanism of a second embodiment taken along line A-A in FIG. 3 which illustrates the front view of the suction chamber.

FIG. 8 is a cross-sectional view of the back surface detection mechanism of the second embodiment taken along line A-A in FIG. 3 which illustrates the front view of the suction chamber 14.

As illustrated in FIG. 8, the back surface detection mechanism 33 of the second embodiment uses a reflecting member 333. The reflecting member 333 is, for example, a mirror. The state of the back surface of the tablet T is acquired by using a mirror. In this case, the first surface detection mechanism 32 grasps the back surface of the tablet T as image information.

That is, for example, a mirror is provided inside the suction chamber 14 as the reflecting member 333, and the imaging device 321 of the first surface detection mechanism 32 acquires the state of the back surface of the tablet T using the reflection of the mirror. The back surface detection mechanism 33 illustrated in FIG. 8 is configured to photograph the state of the back surface of the tablet T located upstream of the surface detection mechanism 32 (the imaging device 321) in the traveling direction of the conveyor belt 13 using two mirrors.

While FIG. 8 illustrates a configuration provided with two mirrors as an example, for example, a lens for focusing on the back surface of the tablet T may be provided between the two mirrors. Besides, it is described that a mirror is used as the reflecting member 333; however, the reflecting member 333 may be anything as long as it enables the back surface of the tablet T to be observed. The reflecting member 333 may be a member that can change the optical path, such as, for example, a prism or an optical fiber.

As described above, when the split line Tw is formed on one side of the tablet T, even if there are variations in the orientation of the split lines Tw of the tablets T being conveyed or the orientation of the surfaces with the split line Tw, printing can be performed on the surfaces of tablets T with the split line Tw and the opposite surfaces such that the print does not overlap the split line Tw or a position corresponding to the split line Tw. Thus, it is able to provide a tablet printing apparatus S and a tablet printing method capable of maintaining the printing quality.

Further, the front and back surfaces of the tablet T are detected while the tablet T is placed on the same conveyor belt 13. Therefore, there is no position difference between the detection of the front surface and the detection of the back surface. Thus, it is possible to detect the surface of the tablet T with higher accuracy and to eliminate positional deviation in printing on both surfaces of the tablet T.

Particularly in the second embodiment, no imaging device is provided as the back surface detection mechanism differently from the first embodiment. This simplifies the configuration of the tablet printing apparatus S as well as reducing the cost for the installation of the back surface detection mechanism.

Other Embodiments

The embodiments described above can be implemented in various other forms, and are susceptible to various omissions, modifications, and alternative forms without departing from the scope of the invention.

For example, regarding the conveyor belt 13, in the first conveyor 1 illustrated in FIG. 2, one (a line of) slit (131) of the conveyor belt 13 is provided with the center in the width direction of the conveyor belt 13; however, there may be a plurality of (a plurality of lines of) slits. Alternatively, the slit 131 may be formed by conveyor belts which are individually and independently stretched over the first pulley 11 and the second pulley 12.

In addition, instead of the slit 131, for example, a recess as a pocket for housing the tablet T may be formed in the conveyor belt 13. Further, a suction portion for sucking and holding the tablet T on the conveyor belt 13 may be formed without the recess.

When a suction portion is formed on the conveyor belt 13, the size, shape, number and the like of the suction portion are not limited. It suffices if it is possible to suck and hold the tablet T as well as to grasp the state of the back surface of the tablets T. Alternatively, the suction portion may be mesh-like holes.

Further, the conveyor belt 13 may be made of a transparent material. If the conveyor belt 13 is formed of a transparent material, it is easier to grasp the state of the back surface of the tablet T, such as the presence or absence of the split line Tw, particularly in the back surface detection mechanism 33 that detects the state of the back surface of the tablet T.

Although the first and second surface detection mechanisms 32, 42 and the back surface detection mechanism 33 are each provided with the illumination, a single illumination such as a ring illumination or the like may be shared by them. With this, the cost can be reduced as compared to the case of using a plurality of illuminations.

Although described as being connected to a pump, the suction path 142 of the chamber body 141 may be configured to be connected to, for example, a plurality of pumps. When several pumps are used separately, the tablets T can be sucked and held with a plurality of suction forces by dividing the suction portion formed over the entire circumference of the conveyor belt 13 into areas.

In the above embodiments, the back surface detection mechanism 33 is described as being located on the upstream side of the first surface detection mechanism 32 in the traveling direction of the conveyor belt 13 as an example. That is, the state of the back surface of the tablet T is checked first, and then the state of the front surface is checked. However, it is not so limited. For example, the back surface detection mechanism 33 may be located on the downstream side of a position detector as the first surface detection mechanism 32.

Further, the first surface detection mechanism 32 and the back surface detection mechanism 33 may be provided at positions facing each other across the conveyor belt 13. In this case, the state of the front surface of the tablet T and that of the back surface are simultaneously detected by the first surface detection mechanism 32 and the back surface detection mechanism 33.

When the first surface detection mechanism 32 and the back surface detection mechanism 33 are arranged at positions shifted in the traveling direction as described above, if the detection information obtained by the detection mechanism arranged on the upstream side includes split line information, the detection mechanism arranged on the downstream side does not need to perform detection. Therefore, the detection mechanism arranged on the downstream side may not perform detection. This reduces the number of processing steps related to the detection on the downstream side. Thus, the processing efficiency can be improved as compared to the case where detection is performed at the same time.

Figure 9:
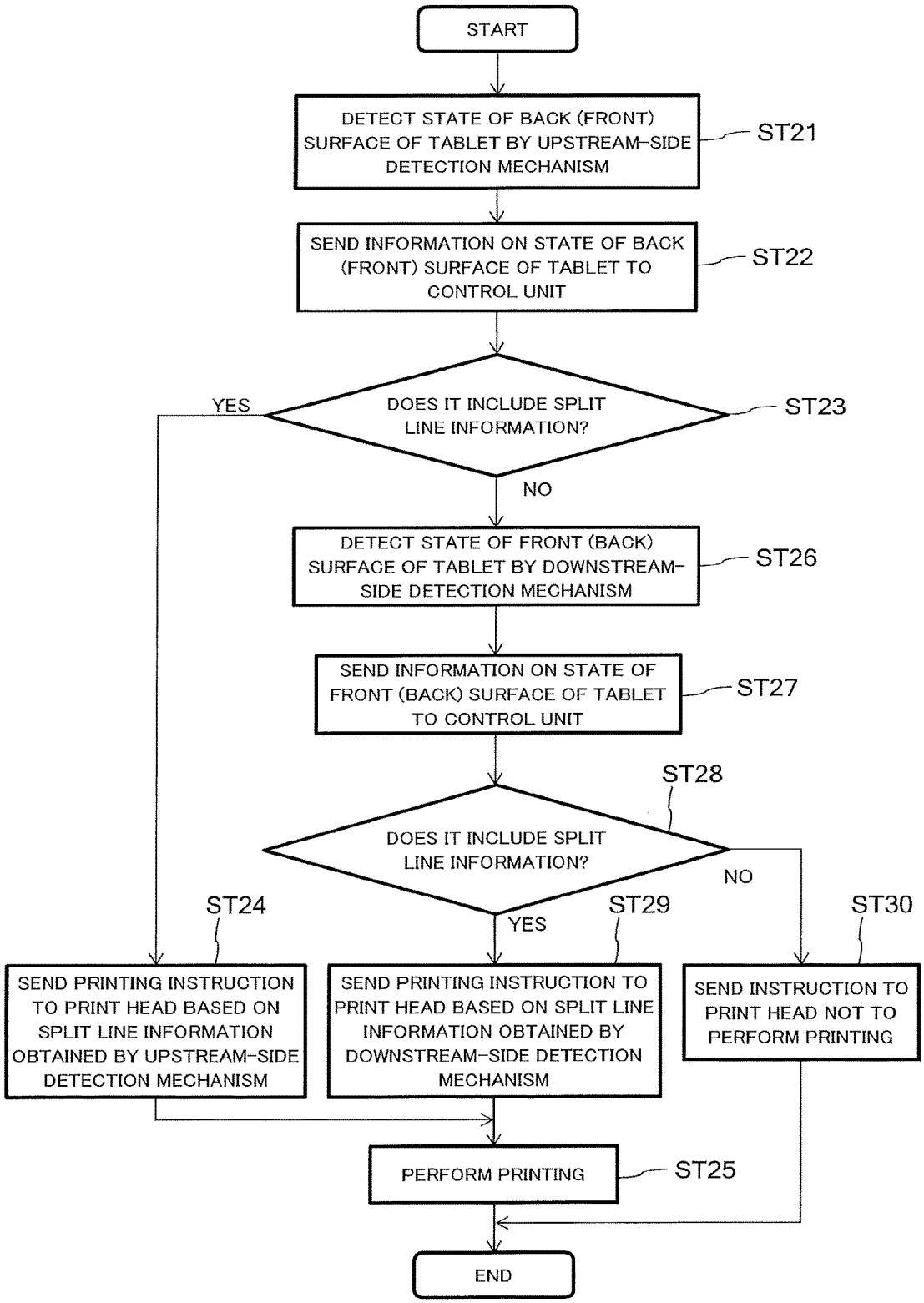
FIG. 9 is a flowchart illustrating one example of the printing process.

More specific printing process will be described with reference to FIG. 9. As illustrated in FIG. 4, the upstream-side detection mechanism illustrated in FIG. 9 is the back surface detection mechanism (second detection mechanism) 33 located on the upstream side of the first surface detection mechanism (first detection mechanism) 32 in the conveyance direction of the tablet T. The downstream-side detection mechanism illustrated in FIG. 9 is the first surface detection mechanism (first detection mechanism) 32 located on the upstream side of the back surface detection mechanism (second detection mechanism) 33 in the conveyance direction of the tablet T.

As illustrated in FIG. 9, the upstream-side detection mechanism detects the state of the back surface of the tablet T (ST21), and sends information on the state to the controller 5 (ST22). When the information on the state of the back surface includes split line information (YES in ST23), the controller 5 sends a printing instruction to the first and second print heads 31 and 41 based on the split line information on the upstream side, i.e., of the back surface (ST24). That is, in this case, the split line Tw is not formed on the front surface of the tablet T being conveyed by the first conveyor 1. Therefore, the first print head 31 performs printing based on a print pattern for the surface having no split line Tw, while the second print head 41 performs printing based on a print pattern for the surface having the split line Tw. Then, the downstream-side detection mechanism does not perform the detection of the state of the surface of the tablet T, i.e., the detection of the tablet T. Since the step of detecting the state of the front surface of the tablet T by the downstream-side detection mechanism is eliminated, the processing efficiency can be improved. When the split line information is not detected by the upstream-side detection mechanism (NO in ST23), the downstream-side detection mechanism detects the state of the front surface of the tablet T when the tablet T passes through the downstream-side detection mechanism (ST26). Information on the state is sent to the controller 5 (ST27). The information on the state includes spit line information (YES in ST28), and a printing instruction is sent to the first and second print heads 31 and 41 based on the split line information (ST29). That is, the first print head 31 performs printing based on a print pattern for the surface having the split line Tw, while the second print head 41 performs printing based on a print pattern for the surface having no split line Tw. As described above, if both the upstream-side and downstream-side detection mechanisms do not detect split line information (NO in ST28), the controller 5 sends an instruction to the first and second print heads 31 and 41 not to perform the printing (ST30). In this case, the printing process in FIG. 9 includes a step of not performing printing.

When the detection information obtained by the detection mechanism located on the upstream side includes split line information, the detection process may be shared such that the detection mechanism located on the upstream side detects only information on the split line Tw and the detection mechanism located on the downstream side detects the position of the tablet T.

In the above description, the second conveyor 2 is also provided with the second surface detection mechanism 42 to detect the state of the surface of the tablet T on the second conveyor belt 23 that faces the second print head 41. This takes into consideration the positional deviation of the tablet T occurring when the tablet T is transferred in an area where the first conveyor belt 13 and the second conveyor belt 23 meet. Accordingly, if the positional deviation caused when the tablet T is transferred from the first conveyor belt 13 to the second conveyor belt 23 is within an allowable range, and it is not necessary to consider the positional deviation, the second surface detection mechanism 42 is not necessary.

The positional deviation at the time of transfer is not limited to deviation only in the conveyance direction of the tablet T, but there is also deviation in a direction intersecting the conveyance direction of the tablet T in a horizontal plane. For example, the first pulley 11 of the first conveyor 1 and the first pulley 21 of the second conveyor 2 illustrated in FIG. 1 are arranged such that their axial centers are aligned in the vertical direction; however, the axial centers of the pulley 11 and the pulley 21 may be shifted such that the first conveyor belt 13 and the second conveyor belt 23 overlap each other. In this case, the tablet T can be transferred at a portion where the first conveyor belt 13 and the second conveyor belt 23 extend in parallel. This facilitates the adjustment of a space between the first conveyor 1 and the second conveyor 2, i.e., the clearance for transferring the tablet T, and a determination on the timing of releasing the suction of the tablet T in the first conveyor 1 and starting the suction of the tablet T in the second conveyor 2. Thus, the positional deviation can be suppressed.

For this reason, it is sufficient to provide at least one pair of detection mechanisms (the first surface detection mechanism 32 and the back surface detection mechanism 33) for printing on both surfaces of the tablet T according to the state of one surface. There is no need to detect both surfaces every time printing is performed on each surface. Thus, the apparatus can be simplified with a configuration having less detection mechanisms. Moreover, the amount of processing for detection can be reduced, resulting in improved processing efficiency.

In the case of using the inkjet print heads 31 and 41 as the printing mechanism P, the driving element for the inkjet print heads is not limited to a piezoelectric element, and may be a heating element or a magnetostrictive element.

In order to reduce the friction with the belt, the surfaces of the suction chambers 14 and 24, which come in contact with the conveyor belts 13 and 23, may be coated by a film, or a tape member may be stuck thereto. The smaller the coefficient of friction is, the less vibration is generated in the conveyor belts 13 and 23, and less vibration occurs in the tablet T being conveyed. Thus, high-quality printing can be performed. Incidentally, as a member for reducing friction, it is preferable to use a member for suppressing the friction coefficient (dynamic friction coefficient) between the suction chambers 14, 24 and the conveyor belts 13, 23 to 0.2 or less.

Examples of the "tablet" include plain tablets (uncoated tablets), sugar-coated tablets, film-coated tablets, enteric-coated tablets, gelatin-coated tablets, multilayered tablets, dry-coated tablets, and the like. In addition, various capsule tablets, irrespective of whether they are made of hard capsules or soft capsules, can also be included in examples of the "tablet".

Further, the "tablets" may include those for pharmaceutical use, edible use, cleaning, industrial use, and aroma use.

When the tablet T to be printed is for pharmaceutical use or edible use, edible ink is preferably used. Specifically, examples of edible pigment include Amaranth, Erythrosine, New Coquine (red), Tartrazine, Sunset Yellow FCF, β-carotene, Crocin (yellow), Brilliant blue FCF, Indigo carmine (blue), and the like. These pigments can be used by dispersing or dissolving them in a vehicle and adding a pigment dispersant (surfactant) thereto as required.

Any of synthetic dye ink, natural color ink, dye ink, and pigment ink may be used as long as it is edible ink.

In the above embodiments, the tablet T is described as being circular in a plan view; however, the shape is not particularly limited. The tablet may be in a polygonal shape such as a hexagon, an oval shape, or the like.

The embodiments and modifications thereof are included in the scope and spirit of the invention, and also included in the scope of the invention described in the claims and the equivalent thereof.

What is claimed is:

1. A tablet printing apparatus configured to perform printing on both surfaces of a tablet that has a split line on one surface of the both surfaces or the other surface, the apparatus comprising:

a first conveyor configured to convey the tablet while holding the other surface of the tablet;

a second conveyor configured to convey the tablet transferred from the first conveyor while holding the one surface of the tablet;

a first print head configured to perform printing on the one surface of the tablet being conveyed by the first conveyor;

a second print head configured to perform printing on the other surface of the tablet being conveyed by the second conveyor;

a first detection mechanism configured to detect the one surface of the tablet being conveyed by the first conveyor;

a second detection mechanism configured to detect the other surface of the tablet being conveyed by the first conveyor; and a controller configured to send a printing instruction to the first print head and the second print head based on information related to a state of the split line included in detection information on the one surface of the tablet acquired by the first detection mechanism or detection information on the other surface of the tablet acquired by the second detection mechanism.

2. The tablet printing apparatus according to claim 1, wherein the second detection mechanism is further configured to detect the other surface of the tablet being conveyed by the first conveyor on upstream side of the first detection mechanism in a conveyance direction of the tablet, when the second detection mechanism acquires the information related to the state of the split line, the controller controls the first detection mechanism not to detect the one surface of the tablet, and sends a printing instruction to the first print head and the second print head based on the detection information acquired by the second detection mechanism, and when the second detection mechanism does not acquire the information related to the state of the split line, the controller controls the first detection mechanism to detect the one surface of the tablet, and sends a printing instruction to the first print head and the second print head based on the detection information acquired by the first detection mechanism.

3. The tablet printing apparatus according to claim 1, wherein the second detection mechanism is further configured to detect the other surface of the tablet being conveyed by the first conveyor on downstream side of the first detection mechanism in a conveyance direction of the tablet, when the first detection mechanism acquires the information related to the state of the split line, the controller controls the second detection mechanism not to detect the other surface of the tablet, and sends a printing instruction to the first print head and the second print head based on the detection information acquired by the first detection mechanism, and when the first detection mechanism does not acquire the information related to the state of the split line, the controller controls the second detection mechanism to detect the other surface of the tablet, and sends a printing instruction to the first print head and the second print head based on the detection information acquired by the second detection mechanism.

4. The tablet printing apparatus according to claim 1, wherein the first conveyor includes a suction chamber configured to apply a suction force to the tablet, and the second detection mechanism is arranged inside the suction chamber.

5. The tablet printing apparatus according to claim 1, wherein the second detection mechanism includes an imaging device configured to photograph and detect a state of the other surface of the tablet.

6. The tablet printing apparatus according to claim 1, wherein the second detection mechanism includes a reflecting member, and is further configured to detect a state of the other surface of the tablet through the reflecting member.

7. The tablet printing apparatus according to claim 1, further comprising a third detection mechanism configured to detect the other surface of the tablet being conveyed by the second conveyor, Wherein the controller is further configured to send a printing instruction to the first print head based on the information related to the state of the split line acquired by the first detection mechanism or the second detection mechanism, and also send a printing instruction to the second print head based on the information related to the state of the split line acquired by the first detection mechanism or the second detection mechanism and detection information acquired by the third detection mechanism.

8. A tablet printing method for performing printing on both surfaces of a tablet that has a split line on one surface of the both surfaces or the other surface, the method comprising:

conveying the tablet by a first conveyor holding the other surface of the tablet;

detecting the one surface of the tablet being conveyed by the first conveyor by a first detection mechanism;

detecting the other surface of the tablet being conveyed by the first conveyor by a second detection mechanism;

performing printing on the one surface of the tablet being conveyed by the first conveyor by a first print head;

conveying the tablet transferred from the first conveyor by a second conveyor holding the one surface of the tablet; and performing printing on the other surface of the tablet being conveyed by the second conveyor by a second print head;

wherein, upon performing the printing, a printing instruction is sent from a controller to the first print head and the second print head based on information related to a state of the split line included in detection information on the one surface of the tablet acquired by the first detection mechanism or detection information on the other surface of the tablet acquired by the second detection mechanism.

9. The tablet printing method according to claim 8, wherein detection of the other surface of the tablet by the second detection mechanism is performed before detection of the one surface of the tablet by the first detection mechanism, upon performing the printing, when the second detection mechanism acquires the information related to the state of the split line, the controller controls the first detection mechanism not to detect the one surface of the tablet, and sends a printing instruction to the first print head and the second print head based on the detection information acquired by the second detection mechanism, and when the second detection mechanism does not acquire the information related to the state of the split line, the controller controls the first detection mechanism to detect the one surface of the tablet, and sends a printing instruction to the first print head and the second print head based on the detection information acquired by the first detection mechanism.

10. The tablet printing method according to claim 8, wherein detection of the other surface of the tablet by the second detection mechanism is performed after detection of the one surface of the tablet by the first detection mechanism, upon performing the printing, when the first detection mechanism acquires the information related to the state of the split line, the controller controls the second detection mechanism not to detect the other surface of the tablet, and sends a printing instruction to the first print head and the second print head based on the detection information acquired by the first detection mechanism, and when the first detection mechanism does not acquire the information related to the state of the split line, the controller controls the second detection mechanism to detect the other surface of the tablet, and sends a printing instruction to the first print head and the second print head based on the detection information acquired by the second detection mechanism.

* * * * *